US011750959B2

(12) United States Patent
Nagata et al.

(10) Patent No.: US 11,750,959 B2
(45) Date of Patent: Sep. 5, 2023

(54) SPEAKER DEVICE

(71) Applicant: SONY GROUP CORPORATION, Tokyo (JP)

(72) Inventors: Koji Nagata, Tokyo (JP); Masatoshi Tanizawa, Tokyo (JP)

(73) Assignee: SONY GROUP CORPORATION, Tokyo (JP)

( * ) Notice: Subject to any disclaimer, the term of this patent is extended or adjusted under 35 U.S.C. 154(b) by 156 days.

(21) Appl. No.: 17/309,573

(22) PCT Filed: Nov. 6, 2019

(86) PCT No.: PCT/JP2019/043466
§ 371 (c)(1),
(2) Date: Jun. 7, 2021

(87) PCT Pub. No.: WO2020/121692
PCT Pub. Date: Jun. 18, 2020

(65) Prior Publication Data

US 2022/0021957 A1 Jan. 20, 2022

(30) Foreign Application Priority Data

Dec. 14, 2018 (JP) ..... 2018-234122

(51) Int. Cl.
*H04R 1/02* (2006.01)
*H04R 1/10* (2006.01)

(52) U.S. Cl.
CPC ..... *H04R 1/028* (2013.01); *H04R 1/10* (2013.01)

(58) Field of Classification Search
CPC . H04R 1/00; H04R 1/02; H04R 1/025; H04R 1/028; H04R 1/10; H04R 1/1058;
(Continued)

(56) References Cited

U.S. PATENT DOCUMENTS 4,977,975 A 12/1990 Lazzeroni et al.
5,136,657 A 8/1992 Hattori
(Continued)

FOREIGN PATENT DOCUMENTS

JP 57-160283 U 10/1982
JP 59-169320 U 11/1984
(Continued)

OTHER PUBLICATIONS

International Search Report and Written Opinion of PCT Application No. PCT/JP2019/043466, dated Dec. 17, 2019, 10 pages of ISRWO.

*Primary Examiner* — Thang V Tran
(74) *Attorney, Agent, or Firm* — CHIP LAW GROUP

(57) ABSTRACT

A speaker device is used while being attached to a helmet, and includes a speaker unit that outputs a sound, a speaker housing that includes a back wall portion covering the speaker unit from a back side, and in which a space between a back surface of the speaker unit and the back wall portion is formed as an output space for the sound output from the back surface of the speaker unit, and a duct whose internal space is communicated with the output space and that guides, to an outside of the helmet, the sound output to the output space, in which a distance between the back surface of the speaker unit and the back wall portion is smaller than a distance of the internal space of the duct in a direction in which the duct guides the sound.

12 Claims, 9 Drawing Sheets

(58) Field of Classification Search
CPC ..... H04R 1/28; H04R 1/2803; H04R 1/2823; H04R 1/2846; H04R 1/2849; H04R 1/2857; H04R 1/32; H04R 1/225; H04R 5/033; H04R 5/0335; H04R 2201/023; H04R 2420/07; A42B 3/30; A42B 3/303; A42B 3/125; A42B 3/166; A42B 1/245
See application file for complete search history.

(56) References Cited

U.S. PATENT DOCUMENTS

| | | | | |
|---|---|---|---|---|
| 2005/0226451 | A1* | 10/2005 | Davis | A42B 3/30 381/372 |
| 2019/0052954 | A1* | 2/2019 | Rusconi Clerici Beltrami | H04R 1/1008 |
| 2019/0238971 | A1* | 8/2019 | Wakeland | H04R 1/347 |

FOREIGN PATENT DOCUMENTS

| | | | |
|---|---|---|---|
| JP | 1-221504 | A | 9/1989 |
| JP | 4-227396 | A | 8/1992 |
| JP | 2001-309477 | A | 11/2001 |
| JP | 2005-163222 | A | 6/2005 |
| WO | 1991/004645 | A1 | 4/1991 |

* cited by examiner

SPEAKER DEVICE

CROSS REFERENCE TO RELATED APPLICATIONS

This application is a U.S. National Phase of International Patent Application No. PCT/JP2019/043466 filed on Nov. 6, 2019, which claims priority benefit of Japanese Patent Application No. JP 2018-234122 filed in the Japan Patent Office on Dec. 14, 2018. Each of the above-referenced applications is hereby incorporated herein by reference in its entirety.

TECHNICAL FIELD

The present technology relates to a technical field of speaker devices used by being attached to a helmet.

BACKGROUND ART

There is a type of speaker device that is used by being attached to a helmet used in various aspects such as when a two-wheeled vehicle such as a motorcycle is running, at a construction site, or for disaster prevention (see, for example, Patent Document 1).

In such a speaker device used by being attached to a helmet, for example, a sound is output in response to a signal input by wireless communication from a mobile terminal such as a mobile phone.

Incidentally, in the speaker device used by being attached to a helmet as described above, in the state where the speaker device is attached to the helmet, it is difficult to secure a sufficiently large space on a back side of a speaker unit due to the presence of an inner surface of a shell provided as an exterior of the speaker device, each pad provided as an interior part, and the like.

In this case, a sound output from a back surface of the speaker unit and a sound output from a front surface of the speaker unit are mixed and cancel each other out as sounds having opposite phases, and the sound pressure sensitivity in a low sound range tends to decrease.

Therefore, a speaker device described in Patent Document 1 suppresses the decrease in the sound pressure sensitivity in the low sound range by forming a side hole and a sound path on a side surface portion of a speaker housing, combining a sound output from a speaker unit via the side hole and the sound path and sounds output from front and back surfaces of the speaker unit, and adjusting a resonance frequency of the sound output via the sound path.

CITATION LIST

Patent Document

Patent Document 1: Japanese Patent Application Laid-Open No. 2001-309477

SUMMARY OF THE INVENTION

Problems to be Solved by the Invention

Since the speaker device as described above is attached to a helmet, it is necessary to make the speaker device thinner to reduce a space for arranging the speaker device inside the helmet, and it is also necessary to suppress the decrease in the sound pressure sensitivity in the low sound range as described above.

Therefore, a purpose of the speaker device of the present technology is to suppress the decrease in the sound pressure sensitivity in the low sound range while the speaker device is made thinner.

Solutions to Problems

Firstly, a speaker device according to the present technology is used while being attached to a helmet, and includes a speaker unit that outputs a sound, a speaker housing that includes a back wall portion covering the speaker unit from a back side, and in which a space between a back surface of the speaker unit and the back wall portion is formed as an output space for the sound output from the back surface of the speaker unit, and a duct whose internal space is communicated with the output space and that guides, to an outside of the helmet, the sound output to the output space, in which a distance between the back surface of the speaker unit and the back wall portion is smaller than a distance of the internal space of the duct in a direction in which the duct guides the sound.

With this configuration, the sound output from the back surface of the speaker unit is emitted to the outside of the helmet through the duct from the output space whose distance in an output direction of the sound is smaller than the distance of the duct in the direction in which the duct guides the sound.

Secondly, in the speaker device described above, it is desirable that at least a part of the speaker housing and at least a part of the duct are integrally formed.

With this configuration, it is not necessary to form the speaker housing and the duct separately.

Thirdly, in the speaker device described above, it is desirable that an output direction of the sound from the back surface of the speaker unit and the direction in which the duct guides the sound are different directions.

With this configuration, the output direction of the sound from the back surface of the speaker unit and a direction in which the duct extends are different directions, and it is possible to freely set the orientation of the duct with respect to the speaker housing.

Fourthly, in the speaker device described above, it is desirable that the output direction of the sound from the back surface of the speaker unit and the direction in which the duct guides the sound are orthogonal directions.

With this configuration, the output direction of the sound from the back surface of the speaker unit and the direction in which the duct extends are orthogonal directions, and the direction in which the duct extends can be orthogonal to a thickness direction of the speaker housing.

Fifthly, in the speaker device described above, it is desirable that an opening at a tip of the duct is formed as a sound outlet that emits the sound to the outside of the helmet, and the sound outlet is located below the speaker housing in a state where the speaker device is attached to the helmet.

With this configuration, the sound output from the back surface of the speaker unit is emitted downward from the duct, so that an opening direction of the helmet and an opening direction of the sound outlet coincide with each other.

Sixthly, in the speaker device described above, it is desirable that the sound outlet is located above a lower opening of the helmet.

With this configuration, the duct does not protrude outward from the lower opening of the helmet, so that it is difficult for outside air to enter the speaker device from the sound outlet.

Seventhly, in the speaker device described above, it is desirable that, in the duct, the distance of the internal space in the direction in which the duct guides the sound is smaller toward a rear of the helmet.

With this configuration, the orientation of the sound outlet does not face a wind flowing from the front toward the speaker device.

Eighthly, in the speaker device described above, it is desirable that an opening at a tip of the duct is formed as a sound outlet that emits the sound to the outside of the helmet, and the sound outlet is located behind the speaker housing in a state where the speaker device is attached to the helmet.

With this configuration, the sound output from the back surface of the speaker unit is emitted toward the rear from the duct, so that it is difficult for the outside air to enter the speaker device from the sound outlet when a two-wheeled vehicle or the like is running.

Ninthly, in the speaker device described above, it is desirable that a cooling space is formed inside the helmet, an air inflow hole and an air outflow hole communicated with the cooling space are formed in the helmet, and the internal space is communicated with the cooling space.

With this configuration, the sound output from the back surface of the speaker unit is emitted to the outside of the helmet through the cooling space and the air outflow hole formed in the helmet.

Tenthly, in the speaker device described above, it is desirable that a sound emission hole is formed in the helmet, and the internal space is communicated with the sound emission hole.

With this configuration, the sound output from the back surface of the speaker unit is emitted to the outside of the helmet through the sound emission hole.

Eleventhly, in the speaker device described above, it is desirable that the helmet includes a cheek pad provided as an interior part, and the speaker device is attached to the helmet in a state where at least a part of the speaker housing or the duct is held by the cheek pad.

With this configuration, the at least a part of the speaker housing or duct is held by the cheek pad in the state where the speaker device is attached to the helmet.

Twelfthly, in the speaker device described above, it is desirable that the speaker device is attached to the helmet in a state where the at least a part of the speaker housing or the duct is sandwiched between the cheek pad and another interior part.

With this configuration, the at least a part of the speaker housing or duct is sandwiched between the cheek pad and another interior part in the state where the speaker device is attached to the helmet.

BRIEF DESCRIPTION OF DRAWINGS

FIG. 1 is a side view of a helmet illustrated in a state where the speaker device is attached.

FIG. 6 is a side view illustrating a state before the cheek pad is attached.

MODE FOR CARRYING OUT THE INVENTION

Hereinafter, a mode for carrying out a speaker device of the present technology will be described with reference to the accompanying drawings.

Configuration of Helmet

Figure 1:
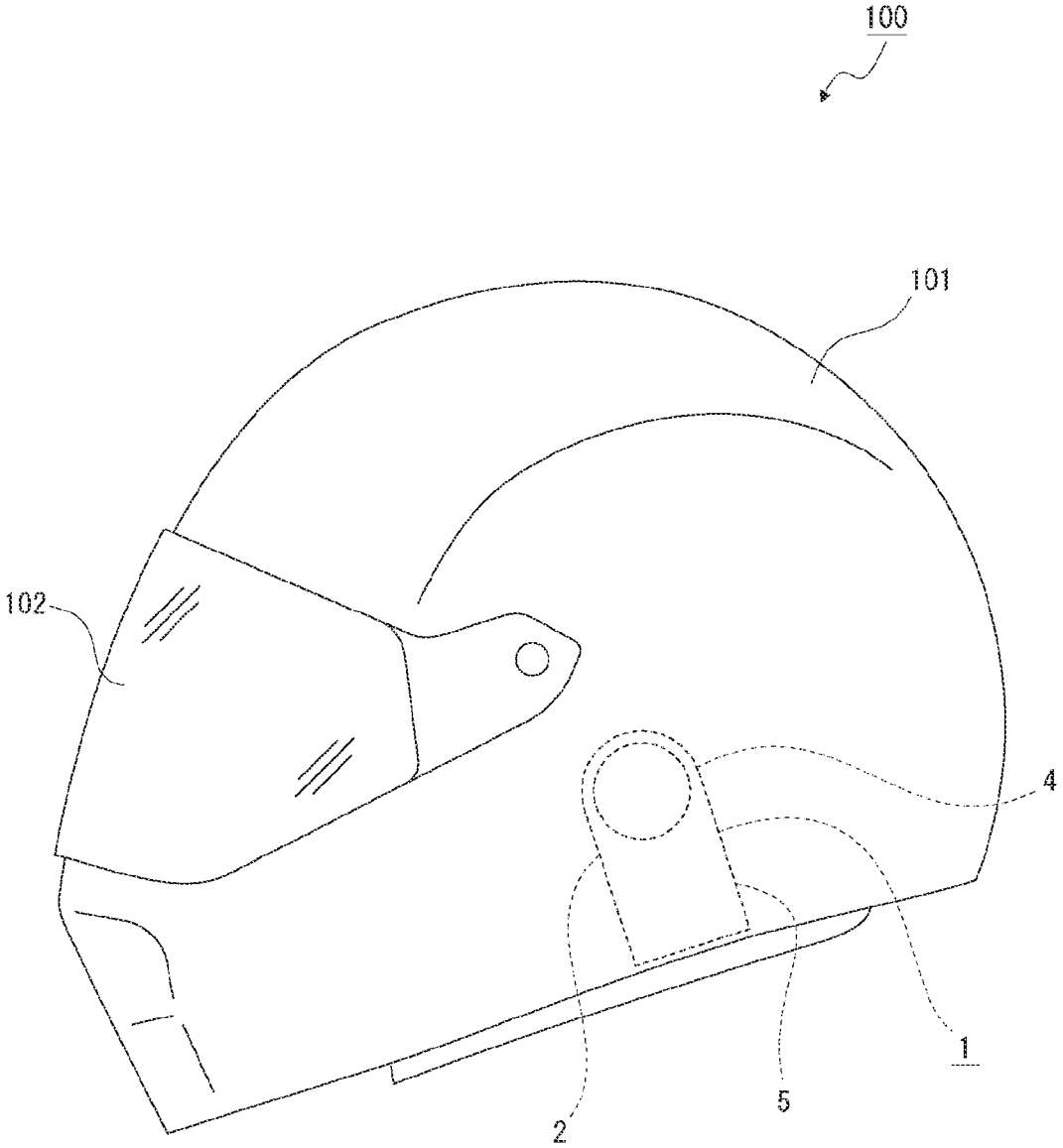
FIG. 1 illustrates an embodiment of a speaker device of the present technology together with FIGS. 2 to 13.
Figure 2:
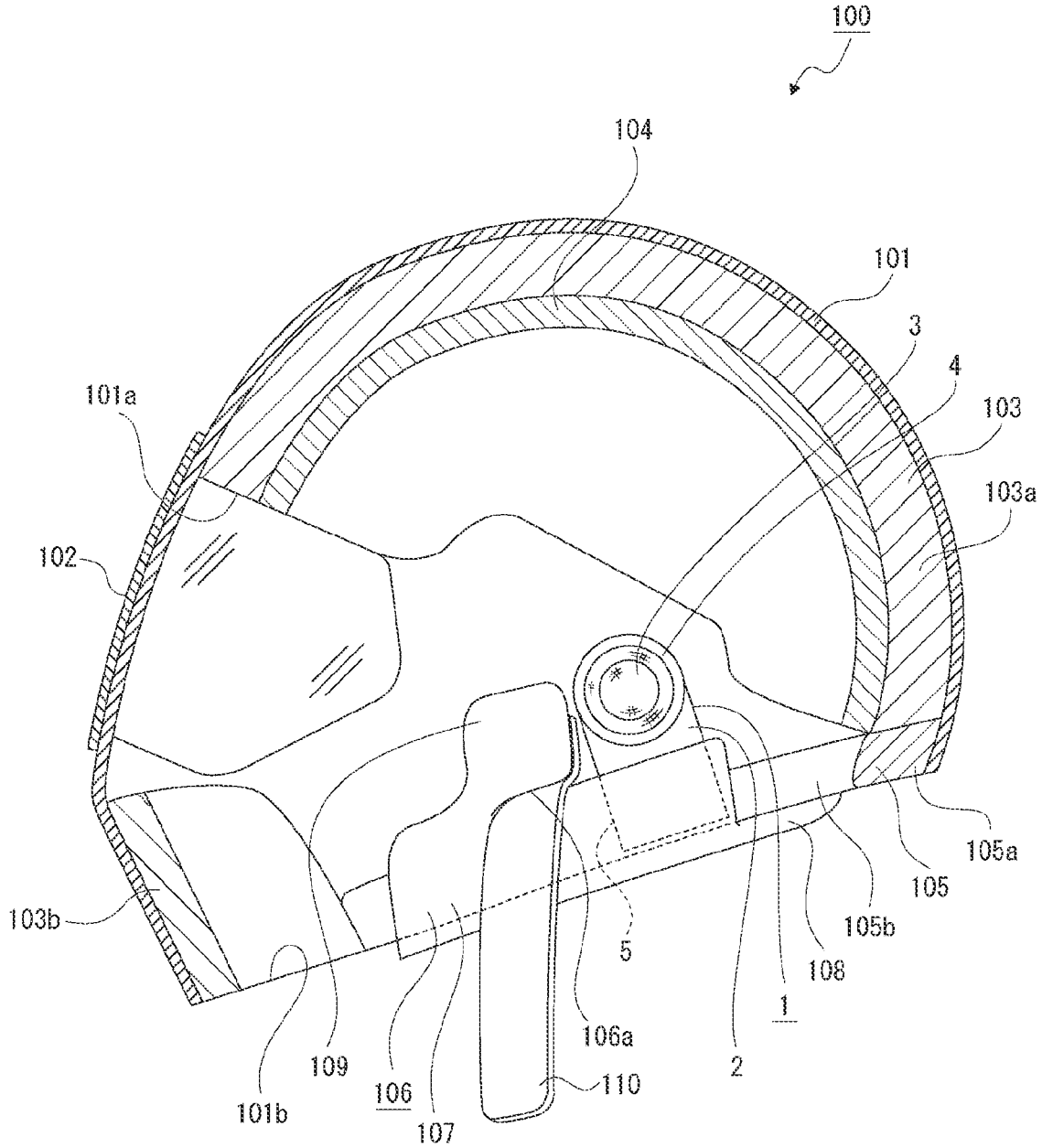
FIG. 2 is a cross-sectional view of the helmet illustrated in the state where the speaker device is attached.
Figure 3:
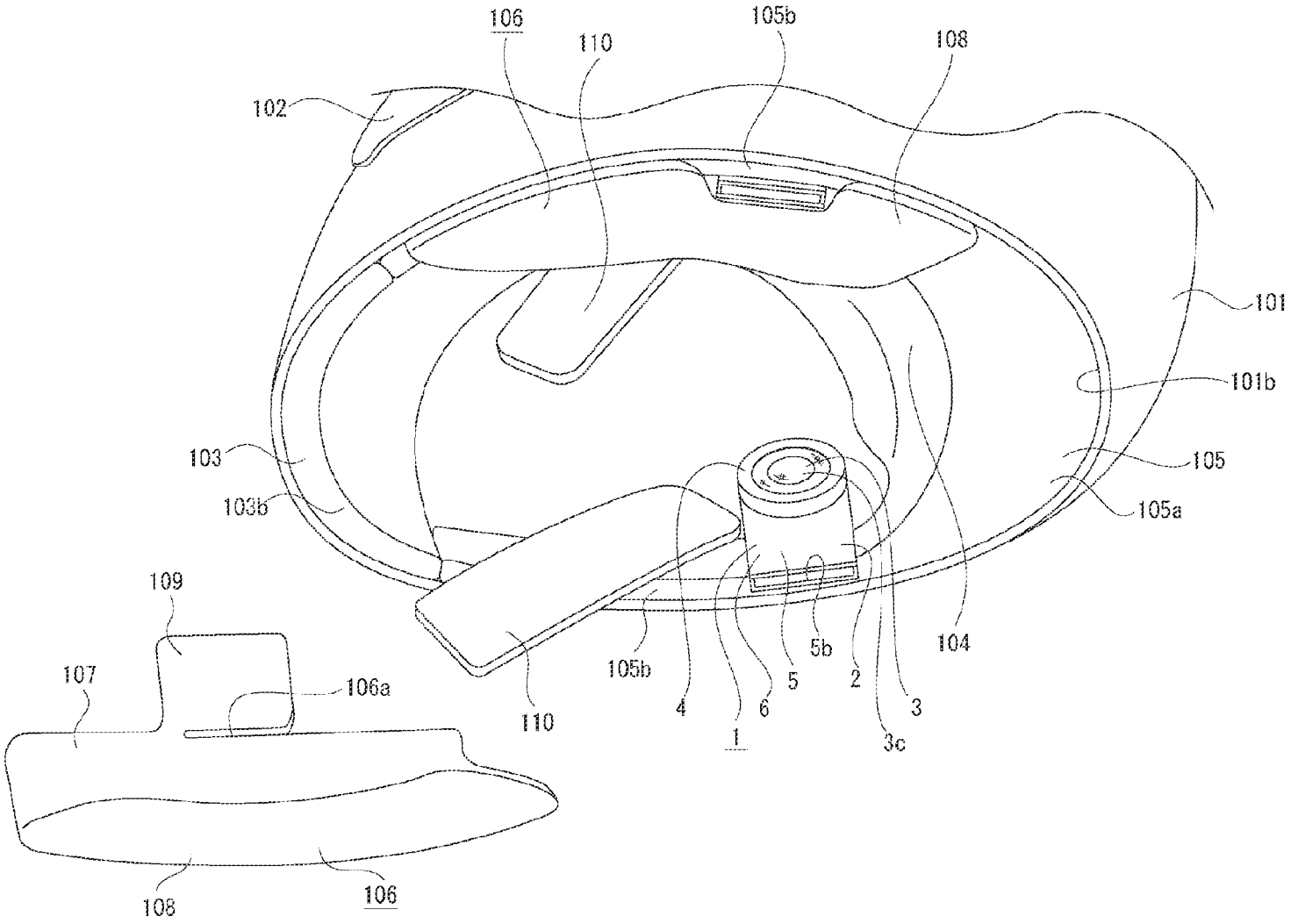
FIG. 3 is a perspective view of the helmet illustrated in a state where one cheek pad is removed and the speaker device is attached.

First, the configuration of a helmet 100 to which a speaker device 1 is attached will be described (see FIGS. 1 to 3).

The helmet 100 is, for example, a helmet for a two-wheeled vehicle such as a motorcycle, and is configured such that necessary parts are attached to or supported by a shell 101 provided as an exterior. Note that the helmet 100 may be, for example, a helmet used at a construction site or the like, or another type of helmet used for disaster prevention or the like.

The shell 101 is opened downward and includes a window portion 101*a* on a front surface side. The shell 101 is formed by use of, for example, a fiber reinforced resin. A transparent face cover 102 that opens and closes the window portion 101*a* is rotatably supported on an outer surface side of the shell 101.

A shock absorbing liner 103 is attached to an inner surface of the shell 101. The shock absorbing liner 103 is formed by use of foamed styrene, and, for example, includes a main liner 103*a* and a front liner 103*b*. The main liner 103*a* is attached in a position extending from an upper part to a rear part of the shell 101, and the front liner 103*b* is attached to a lower part in a front part of the shell 101. The shock absorbing liner 103 is covered with a cloth cover not illustrated.

A head pad 104 as an interior part is attached to the inside of the shell 101. The head pad 104 is attached to the shell 101 by, for example, a hook stopper, a fastener stopper, or the like.

The head pad 104 mainly includes a cushioning material such as urethane foam, and has a function of receiving a head in a state where the helmet 100 is worn by an occupant.

The head pad 104 is attached to the shell 101 so as to cover the main liner 103*a* from an inner side.

A neck pad 105 as an interior part is attached to the inside of the shell 101. The neck pad 105 is attached to the shell 101 by, for example, a hook stopper, a fastener stopper, or the like. Note that the neck pad 105 may be integrally formed with the head pad 104.

The neck pad 105 mainly includes a cushioning material such as urethane foam, and has a function of receiving a neck in the state where the helmet 100 is worn by the occupant. The neck pad 105 is formed in a substantially U shape that is opened forward, and includes a rear portion 105*a* located on a rear side and side portions 105*b* and 105*b* that are continuous with both left and right end portions of the rear portion 105*a*.

The neck pad 105 is attached to the shell 101 with the rear portion 105*a* located below a lower end portion of the main liner 103*a* and a lower end portion of the neck pad 104. The neck pad 105 has the side portions 105*b* and 105*b* each attached to an inner peripheral portion of a lower end portion of the shell 101 between the main liner 103*a* and the front liner 103*b*.

Cheek pads 106 and 106 as interior parts are attached to left and right side portions of the inner surface of the shell 101, respectively. The cheek pad 106 is attached to the shell 101 by, for example, a hook stopper, a fastener stopper, or the like.

The cheek pad 106 mainly includes a cushioning material such as urethane foam, and has a function of receiving a cheek in the state where the helmet 100 is worn by the occupant.

The cheek pad 106 includes a receiving surface portion 107 that faces a left-right direction and is formed in a shape extending substantially back and forth, a bent surface portion 108 that is bendable from the receiving surface portion 107 in the left-right direction and is continuous with a lower edge of the receiving surface portion 107, and a protruding surface portion 109 that protrudes upward from a part of an upper edge of the receiving surface portion 107. The cheek pad 106 has a notch 106*a* formed between the receiving surface portion 107 and the protruding surface portion 109.

In the cheek pad 106, the bent surface portion 108 is bent from the receiving surface portion 107 at a substantially right angle, and for example, the cheek pad 106 is attached to the shell 101 so that parts of the bent surface portion 108 cover parts of the neck pad 105, respectively, from below. In the state where the cheek pad 106 is attached to the shell 101, the receiving surface portion 107 and the protruding surface portion 109 are located along the side portions of the inner surface of the shell 101.

One end portions of jaw belts 110 and 110 are attached to the inner surface of the shell 101, and the jaw belts 110 and 110 protrude downward from a lower opening 101*b* of the shell 101. The jaw belt 110 is inserted through the notch 106*a* of the cheek pad 106 and protrudes downward from the lower opening 101*b* of the shell 101 with the cheek pad 106 attached to the side portion of the inner surface of the shell 101.

Other end portions of the jaw belts 110 and 110 are connected to each other, and the jaw belts 110 and 110 are attached to a jaw of the occupant in the state where the helmet 100 is worn by the occupant.

Note that the configuration of the helmet 100 described above is an example, and the shape, size, and position of the shock absorbing liner 103, the shapes, sizes, and positions of the head pad 104, the neck pad 105, and the cheek pad 106, and the like may have other configurations. Furthermore, as the interior parts of the helmet 100, only the head pad 104 and the cheek pad 106 may be provided.

Configuration of Speaker Device

Next, the configuration of the speaker 1 attached to the helmet 100 will be described (see FIGS. 4 and 5).

Figure 4:
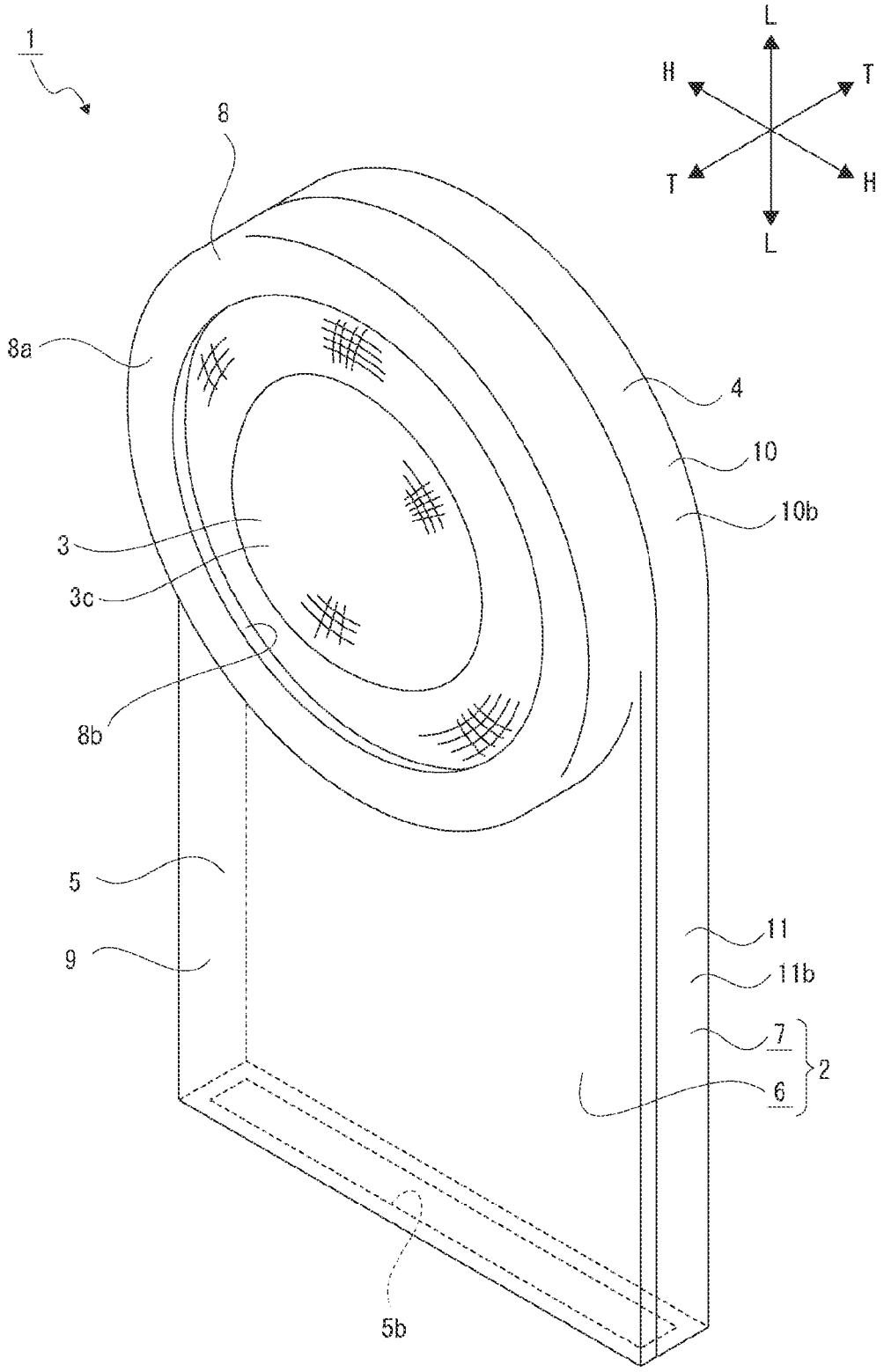
FIG. 4 is an enlarged perspective view of the speaker device.
Figure 5:
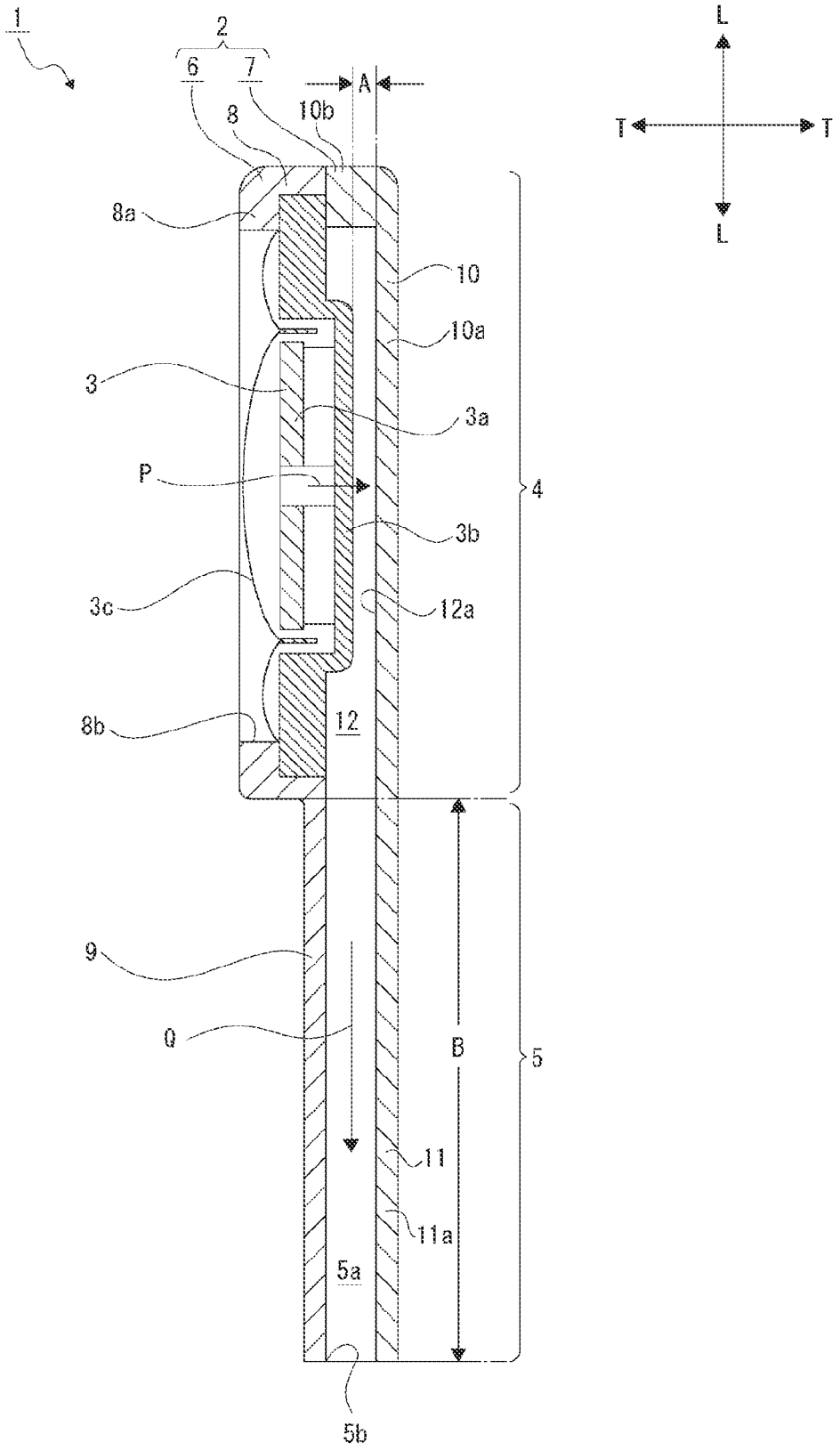
FIG. 5 is an enlarged cross-sectional view of the speaker device.

The speaker device 1 is, for example, a dynamic speaker device, and includes a case body 2 and a speaker unit 3 (see FIGS. 4 and 5).

The case body 2 includes a speaker housing 4 having a substantially circular outer shape and a duct 5 continuous with the speaker housing 4 and having a substantially rectangular outer shape, and for example, a front side portion and back side portion of the speaker housing 4 are integrally formed with a front side portion and a back side portion of the duct 5, respectively.

As described above, in the speaker device 1, since at least a part of the speaker housing 4 and at least a part of the duct 5 are integrally formed, it is not necessary to form the speaker housing 4 and the duct 5 separately, and it is possible to reduce the number of parts and the manufacturing cost of the speaker device 1. Note that the speaker housing 4 and the duct 5 may be provided as separate members.

The case body 2 is configured by a front case 6 and a rear case 7 being connected. In the speaker device 1, the side of the front case 6 is a front side, the side of the rear case 7 is a back side, and a connection direction between the front case 6 and the rear case 7 is a thickness direction.

The front case 6 includes a substantially annular retaining portion 8 and a rectangular flat plate portion 9 continuous with the retaining portion 8. The retaining portion 8 is provided with a flange-shaped holding portion 8*a* projecting inward from an end portion on the front side. In the retaining portion 8, a circular space is formed on an inner side of the holding portion 8*a*, and this space is formed as a sound output hole 8*b*.

The rear case 7 includes a first connecting portion 10 connected to the retaining portion 8 and a second connecting portion 11 connected to the flat plate portion 9.

The first connecting portion 10 includes a substantially circular back wall portion 10*a* and a peripheral surface portion 10*b* protruding to the front side from a portion of an outer peripheral portion of the back wall portion 10*a* excluding a part, and an end surface of the peripheral surface portion 10*b* on the front side is abutted against an end surface of the retaining portion 8 on the back side to couple the first connecting portion 10 to the retaining portion 8. The speaker housing 4 is configured by the retaining portion 8 and the first connecting portion 10 being connected, and a space inside the speaker housing 4 is formed as an arrangement space 12.

The second connecting portion 11 includes a rectangular facing surface portion 11*a* and side surface portions 11*b* and 11*b* protruding to the front side from both side edges of the facing surface portion 11*a*, respectively, and end surfaces of the side surface portions 11*b* and 11*b* on the front side are abutted against both side edges of the flat plate portion 9 to connect the second connecting portion 11 to the flat plate portion 9. The duct 5 is configured by the flat plate portion 9 and the second connecting portion 11 being connected, and a part of a sound output from the speaker unit 3 is guided in an internal space 5*a* of the duct 5. An opening of the duct 5 on an opposite side of the speaker housing 4 is formed as a sound outlet 5*b*.

The duct 5 is formed in a tubular shape extending in a direction orthogonal to the thickness direction of the speaker device 1, and in the duct 5, a thickness direction T is smaller than a width direction H and a length direction L to make the duct 5 thinner. Furthermore, the thickness of the speaker housing 4 is slightly larger than that of the duct 5, but in the speaker housing 4, the thickness direction T is smaller than the width direction H and the length direction L to make the speaker housing 4 thinner. Therefore, in the speaker device 1 as a whole, the thickness direction T is smaller than the width direction H and the length direction L to make the speaker device 1 thinner.

The speaker unit 3 is arranged in the speaker housing 4. The speaker unit 3 includes a drive unit 3*a* having a coil and a magnet, a unit case 3*b* in which the drive unit 3*a* is arranged, and a diaphragm 3*c* supported by the unit case 3*b* on the front side of the drive unit 3*a*. An axial direction of the speaker unit 3 coincides with the thickness direction of the case body 2, the unit case 3*b* is arranged in the arrangement space 12 of the speaker housing 4 while being retained by the retaining portion 8 from an outer peripheral side, and the diaphragm 3*c* is located in the sound output hole 8*b*.

In the state where the speaker unit 3 is arranged in the arrangement space 12, the unit case 3*b* and the back wall portion 10*a* of the first connecting portion 10 are located so as to face each other in the thickness direction of the case body 2, a space is formed between an end surface of the speaker unit 3 on the back side and a surface of the back wall portion 10*a* on the front side, and this space is used as an output space 12*a*. The output space 12*a* of the speaker housing 4 is communicated with the internal space 5*a* of the duct 5.

In the speaker device 1, a distance A between a back surface 3*a* of the speaker unit 3, which is an end surface of the unit case 3*b* on the back side, and the surface of the back wall portion 10*a* on the front side is smaller than a distance B of the internal space 5*a* of the duct 5 in a direction of guiding the sound (See FIG. 5).

A signal is input to the speaker unit 3, for example, by wireless communication, and the sound is output according to the input signal. Note that the speaker device 1 may be of a type in which the signal is input to the speaker unit 3 by wire.

The sound is output from the speaker unit 3 to the front side through the sound output hole 8*b*. Furthermore, in the speaker device 1, a part of the sound is output from the speaker unit 3 to the back side. The sound output to the back side passes through the output space 12*a* and the internal space 5*a* of the duct 5 in order inside the speaker housing 4, and is emitted from the sound outlet 5*b* to the outside of the speaker device 1.

As described above, in the speaker device 1, an output direction P in which the sound is output from the back surface 3*a* of the speaker unit 3 and a direction Q in which the duct 5 guides the sound are orthogonal directions (see FIG. 5).

At this time, in the speaker housing 4, the arrangement space 12 is not open except for the sound output hole 8*b*, and in the duct 5, the internal space 5*a* is not open except for the sound outlet 5*b*. Thus, the sound output from the speaker unit 3 to the back side is not emitted to the outside of the speaker device 1 when passing through the output space 12*a* and the internal space 5*a*, and is emitted to the outside of the speaker device 1 only from the sound outlet 5*b*.

Attachment State of Speaker Device to Helmet

Next, an attachment state of the speaker device 1 to the helmet 100 will be described (see FIGS. 2, 3, 6, and 7).

The speaker devices 1 and 1 are attached to both left and right side portions of the inner surface of the shell 101 in an orientation in which front surfaces of the speaker device 1 and 1 face each other. The speaker device 1 is attached to the shell 101 by various means such as adhesion, sticking, engagement, and holding with another member. The speaker device 1 is attached in an orientation in which the back wall portion 10*a* of the case body 2 faces the inner surface of the shell 101, and the diaphragm 3*c* of the speaker unit 3 faces an ear side.

A procedure for attaching the speaker device 1 to the helmet 100 will be described below (see FIGS. 6 and 7).

Figure 6:
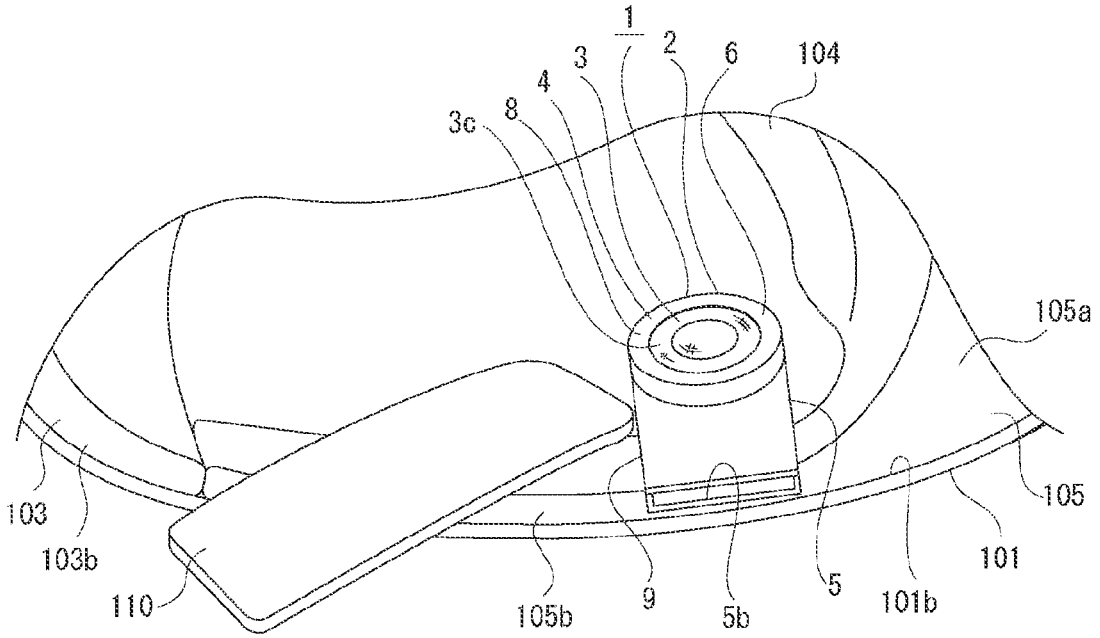
FIG. 6 is for describing a procedure for attaching the speaker device to the helmet together with FIG. 7.

The speaker device 1 is arranged on the inner surface of the shell 101 in a state where the head pad 104 and the neck pad 105 are attached to the shell 101 and the cheek pad 106 is not attached to the shell 101 yet (see FIG. 6). At this time, the duct 5 of the speaker device 1 is pressed against the side portion 105*b* of the neck pad 105.

Figure 7:
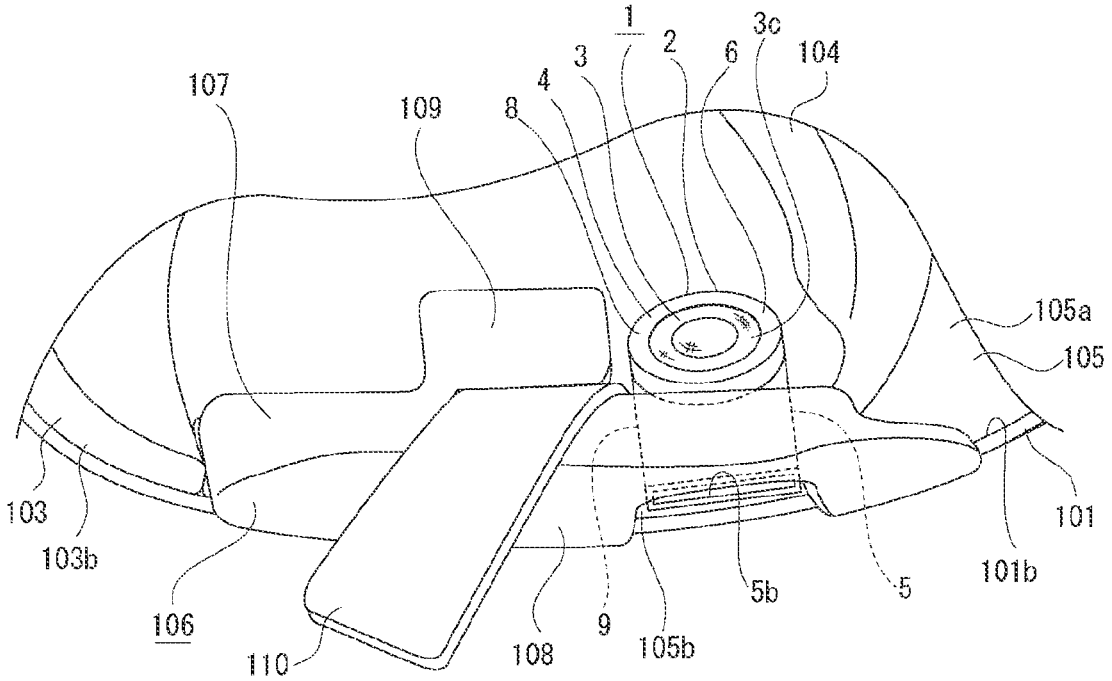
FIG. 7 is a side view illustrating a state where the cheek pad is attached and the speaker device is attached to the helmet.

When the speaker device 1 is arranged on the inner surface of the shell 101, the cheek pad 106 is attached to the shell 101 so as to cover a part of the speaker device 1 from the inner side (see FIG. 7). In the speaker device 1, for example, the duct 5 is held from the inner side by the receiving surface portion 107 of the cheek pad 106, and is sandwiched between the side portion 105*b* of the neck pad 105 and the receiving surface portion 107 of the cheek pad 106. At this time, the receiving surface portion 107 of the cheek pad 106 and the side portion 105*b* of the neck pad 105 sandwiching the duct 5 are in a deformed state.

Note that, if the speaker device 1 is in a state where the sound output from the speaker unit 3 is not hindered, the duct 5 and the speaker housing 4 may be held from the inner side by the receiving surface portion 107 of the cheek pad 106, or the speaker housing 4 may be held from the inner side by the receiving surface portion 107 of the cheek pad 106.

The cheek pad 106 is attached to the shell 101 as described above, so that the speaker device 1 is attached to the helmet 100. In the state where the speaker device 1 is attached to the helmet 100, the duct 5 is held by the receiving surface portion 107 of the cheek pad 106, and the retaining portion 8, a part of which protrudes toward the ear side from the duct 5, is located above the receiving surface portion 107.

Therefore, since the retaining portion 8 can be supported from below by the receiving surface portion 107, it is possible to prevent the speaker device 1 from falling. However, the speaker device 1 may be attached to the helmet 100 by another means such as an adhesive tape.

Furthermore, since the speaker device 1 is attached to the helmet 100 with at least a part of the speaker housing 4 or the duct 5 held by the cheek pad 106, the at least a part of the speaker housing 4 or the duct 5 is held by the cheek pad 106 in the state where the speaker device 1 is attached to the helmet 100, and the speaker device 1 can be attached to the helmet 100 in a stable state.

Moreover, the speaker device 1 is attached to the helmet 100 with the at least a part of the speaker housing 4 or the duct 5 sandwiched between the cheek pad 106 and another interior part, for example, the neck pad 105.

Therefore, since the at least a part of the speaker housing 4 or the duct 5 is sandwiched between the cheek pad 106 and the other interior part in the state where the speaker device 1 is attached to the helmet 100, the speaker device 1 can be attached to the helmet 100 in a stable state, and can be prevented from being damaged or scratched.

When the sound is output from the speaker unit 3 in the state where the speaker device 1 is attached to the helmet 100 as described above, the sound output from the speaker unit 3 to the front side reaches an ear through the sound output hole 8*b*, and the sound output from the speaker unit 3 to the back side is emitted from the sound outlet 5*b* to the outside of the speaker device 1 through the output space 12*a* of the speaker unit 3 and the internal space 5*a* of the duct 5 in order.

In the state where the speaker device 1 is attached to the helmet 100 as described above, the sound outlet 5*b* of the duct 5 is located below the speaker housing 4 (see FIG. 2).

Therefore, since the sound output from the back surface 3*a* of the speaker unit 3 is emitted downward from the duct 5, an opening direction of the helmet 100 and an opening direction of the sound outlet 5*b* coincide with each other, and the sound output from the back surface 3*a* of the speaker unit 3 can be easily and surely emitted to the outside of the helmet 100.

Furthermore, in the state where the speaker device 1 is attached to the helmet 100, the sound outlet 5*b* is located above the lower opening 101*b* of the helmet 100.

Therefore, since the duct 5 does not protrude outward from the lower opening 101*b* of the helmet 100, it is difficult for outside air to enter the speaker device 1 from the sound outlet 5*b*, and, for example, generation of wind noise is suppressed when the two-wheeled vehicle is running, which enables improvement of the quality of the sound output from the speaker unit 3.

Another Attachment State of Speaker Device to Helmet

Another attachment state of the speaker device 1 to the helmet 100 will be described below (see FIGS. 8 and 9).

The above description shows an example in which the speaker device 1 is attached to the helmet 100 with the speaker housing 4 located above the duct 5, but the speaker device 1 may be attached to the helmet 100 with the speaker housing 4 located at a position other than above the duct 5, and may be attached to the helmet 100 in a state where the speaker housing 4 and the duct 5 are aligned back and forth or aligned diagonally with respect to a vertical direction or the left-right direction.

Figure 8:
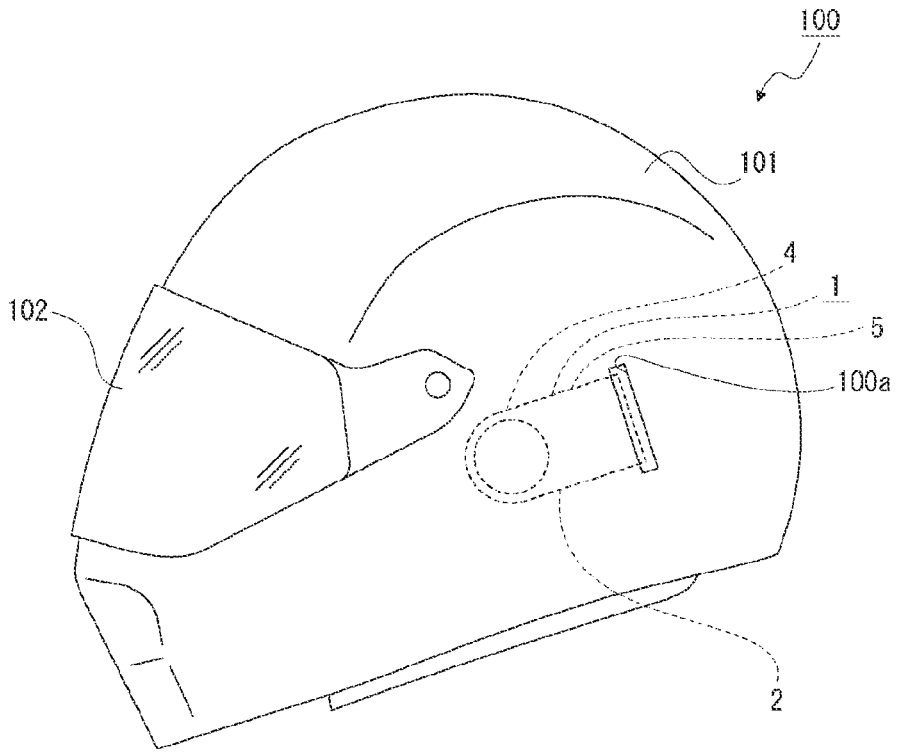
FIG. 8 is a side view illustrating the helmet to which the speaker device is attached in an orientation in which a speaker housing is located in front of a duct.
Figure 9:
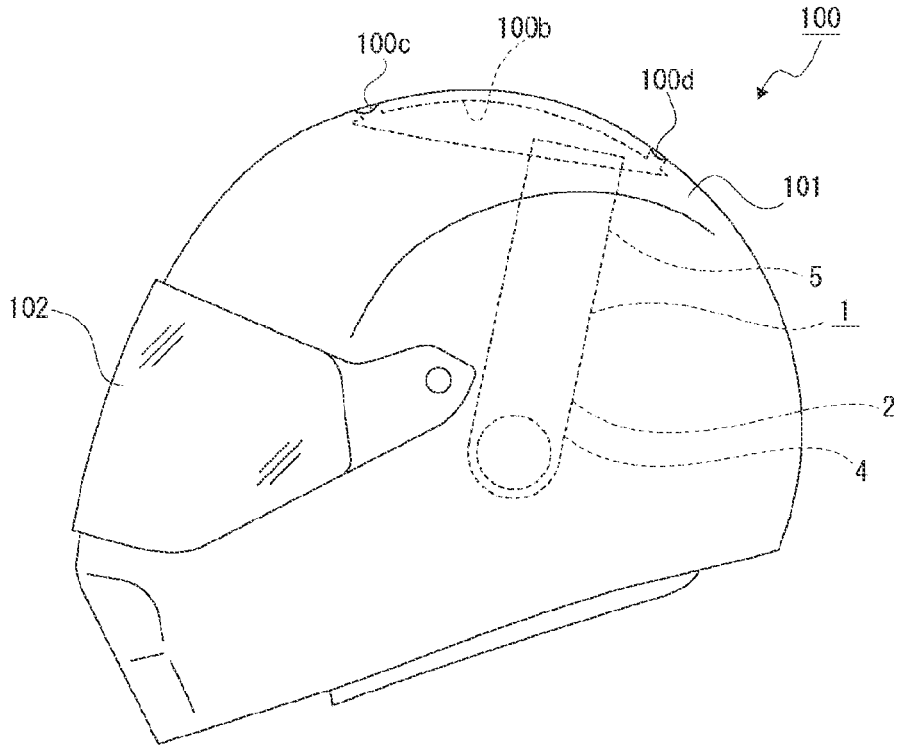
FIG. 9 is a side view illustrating the helmet to which the speaker device is attached in an orientation in which the speaker housing is located below the duct.

The speaker device 1 may be attached to the helmet 100, for example, with the speaker housing 4 located on a front side of the duct 5 (see FIG. 8). In this case, the helmet 100 is formed with a sound emission hole 100*a*, the internal space 5*a* of the duct 5 is communicated with the sound emission hole 100*a*, and the sound is emitted from the sound emission hole 100*a* to the outside of the helmet 100 through the sound outlet 5*b*.

As described above, the helmet 100 is formed with the sound emission hole 100*a* with which the internal space 5*a* of the duct 5 is communicated, so that the sound output from the back surface 3*a* of the speaker unit 3 is emitted from the sound emission hole 100*a* to the outside of the helmet 100, and thus, the sound output from the back surface 3*a* of the speaker unit 3 can be easily emitted to the outside of the helmet 100 with a simple configuration.

Furthermore, in a case where the speaker device 1 is attached to the helmet 100 with the speaker housing 4 located on the front side of the duct 5, the sound outlet 5*b* is located behind the speaker housing 4.

Therefore, since the sound output from the back surface 3*a* of the speaker unit 3 is emitted from the duct 5 toward the rear, it is difficult for the outside air to enter the speaker device 1 from the sound outlet 5*b*, and the generation of the wind noise is suppressed when the two-wheeled vehicle or the like is running, for example. Thus, the quality of the sound output from the speaker unit 3 can be improved, and the sound output from the back surface 3*a* of the speaker unit 3 can be easily emitted to the outside of the helmet 100.

The speaker device 1 may be attached to the helmet 100, for example, with the speaker housing 4 located below the duct 5 (see FIG. 9). Also in this case, the helmet 100 is formed with the sound emission hole 100*a* for emitting the sound from the sound outlet 5*b* to the outside of the helmet 100.

However, depending on the type of the helmet 100, a cooling space 100*b* is formed in an upper part inside the helmet 100, and an air inflow hole 100*c* and an air outflow hole 100*d* communicated with the cooling space 100*b* are formed. In the helmet 100 having such a configuration, the outside air flows into the cooling space 100*b* from the air inflow hole 100*c*, the air flowing into the cooling space 100*b* cools a space inside the helmet 100, and the air in the cooling space 100*b* used for cooling is discharged to the outside from the air outflow hole 100*d*. Therefore, a temperature rise in the space inside the helmet 100 is suppressed, and a good wearing state of the helmet 100 is ensured for a user.

In a case where the speaker device 1 is attached to the helmet 100 having the configuration as described above, a configuration can be adopted in which the internal space 5*a* of the duct 5 is communicated with the cooling space 100*b* through the sound outlet 5*b*.

As described above, if the speaker housing 4 is located below the duct 5, and the internal space 5*a* of the duct 5 is communicated with the cooling space 100*b*, the sound output from the back surface 3*a* of the speaker unit 3 is emitted to the outside of the helmet 100 through the cooling space 100*b* and the air outflow hole 100*d* formed in the helmet 100.

Therefore, the space formed in advance in the helmet 100 is utilized to emit, to the outside of the helmet 100, the sound output from the back surface 3*a* of the speaker unit 3, and the sound output from the back surface 3*a* of the speaker unit 3 can be surely emitted to the outside of the helmet 100.

Others

Figure 10:
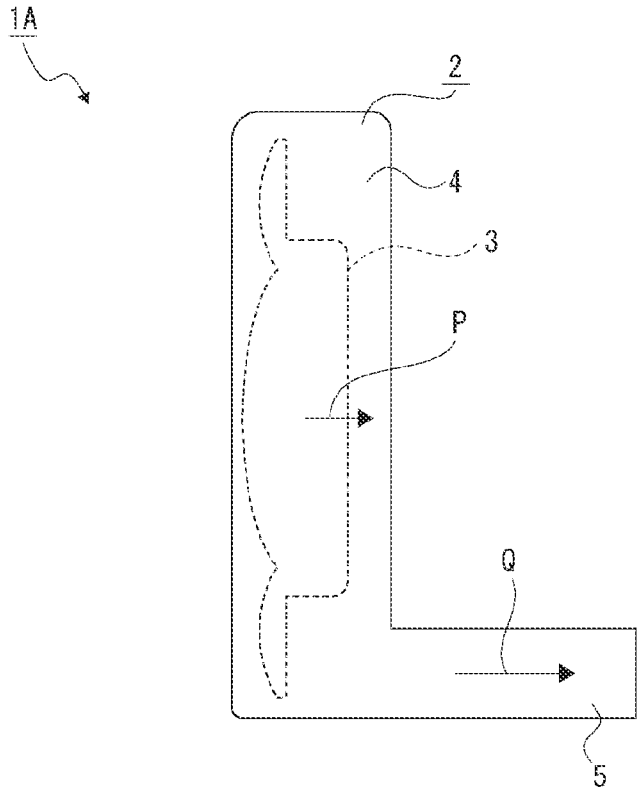
FIG. 10 is a side view illustrating an example of the speaker device in which an output direction of a sound from a back surface of the speaker unit and a direction in which the duct guides the sound are the same direction.
Figure 11:
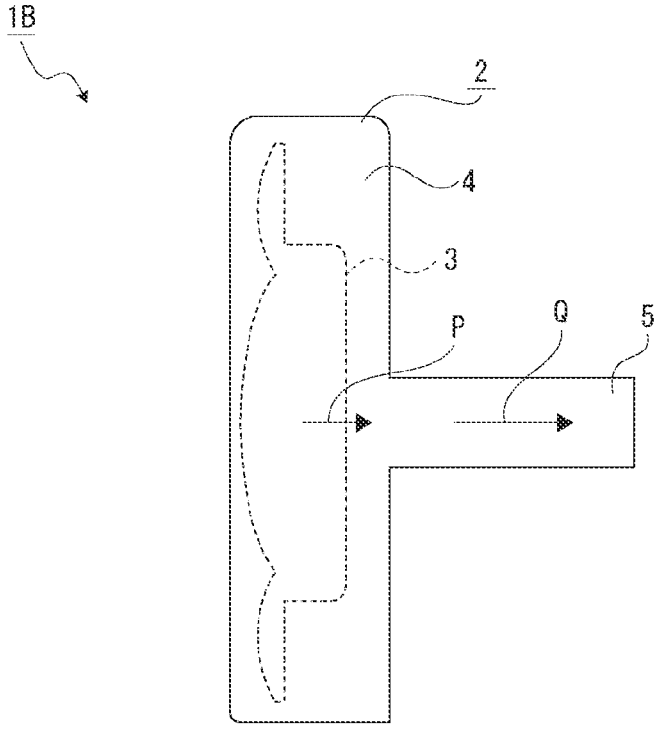
FIG. 11 is a side view illustrating another example of the speaker device in which the output direction of the sound from the back surface of the speaker unit and the direction in which the duct guides the sound are the same direction.

The above description shows, as an example, the speaker device 1 in which the output direction P of the sound from the back surface 3*a* of the speaker unit 3 and the direction Q in which the duct 5 guides the sound are orthogonal directions (see FIG. 5). However, as in speaker devices 1A and 1B, the output direction P of the sound from the back surface 3*a* of the speaker unit 3 and the direction Q in which the duct 5 guides the sound may be the same direction (see FIGS. 10 and 11).

In this case, the duct 5 is continuously provided on the back wall portion 10*a* of the speaker housing 4, and the sound output from the back surface 3*a* of the speaker unit 3 is guided to the back side by the duct 5 and emitted from the back side to the outside of the helmet 100.

Figure 12:
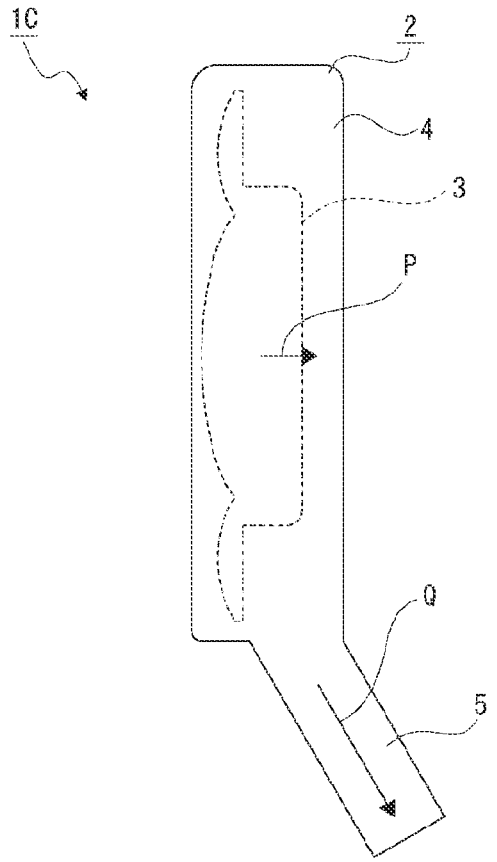
FIG. 12 is a side view illustrating an example of the speaker device in which the output direction of the sound from the back surface of the speaker unit and the direction in which the duct guides the sound are different directions.

Furthermore, as in a speaker device 1C, the output direction P of the sound from the back surface 3*a* of the speaker unit 3 and the direction Q in which the duct 5 guides the sound may be different directions that are not orthogonal (see FIG. 12). In the speaker device 1C, for example, a direction in which the duct 5 extends is inclined with respect to the output direction P of the sound from the speaker unit 3.

In the speaker device 1 and the speaker device 1C, since the output direction P of the sound from the back surface 3*a* of the speaker unit 3 and the direction Q in which the duct 5 guides the sound are different directions, the output direction P of the sound from the back surface 3*a* of the speaker unit 3 and the direction in which the duct 5 extends are different directions, and it is possible to freely set the orientation of the duct 5 with respect to the speaker housing 4.

Therefore, the degree of freedom in the shapes of the speaker housing 4 and the duct 5 is increased, the speaker device 1 can be miniaturized, and the space inside the helmet 100 can be effectively utilized.

Particularly, in the speaker device 1, since the output direction P of the sound from the back surface 3*a* of the speaker unit 3 and the direction Q in which the duct 5 guides the sound are orthogonal directions, the output direction P of the sound from the back surface 3*a* of the speaker unit 3 and the direction in which the duct 5 extends are orthogonal directions.

Therefore, the direction in which the duct 5 extends can be orthogonal to the thickness direction of the speaker housing 4, the speaker device 1 can be made thinner, and the space inside the helmet 100 can be effectively utilized.

Figure 13:
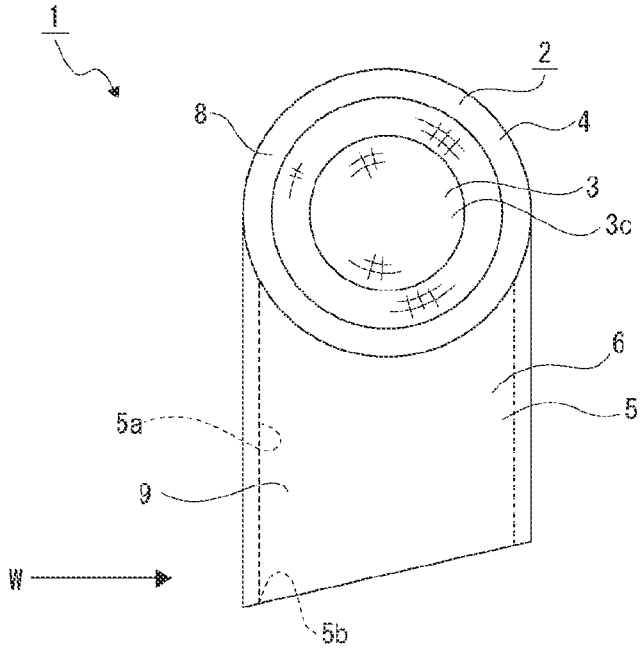
FIG. 13 is a front view illustrating an example of the speaker device in which a tip surface of the duct is inclined.

Furthermore, it is desirable that, in the duct 5, the distance of the internal space 5*a* in the direction of guiding the sound is smaller toward the rear of the helmet 100 (see FIG. 13). For example, in a case where the speaker device 1 is attached to the helmet 100 with the duct 5 located below the speaker housing 4, the vertical length of the duct 5 is shortened toward the rear, so that the sound outlet 5*b* faces diagonally downward and backward.

The distance of the internal space 5*a* in the direction in which the duct 5 guides the sound is smaller toward the rear of the helmet 100 as described above, so that the orientation of the sound outlet 5*b* does not face a wind W flowing from the front toward the speaker device 1 when the two-wheeled vehicle or the like is running, for example. Thus, it is difficult for the outside air to enter the speaker device 1 from the sound outlet 5*b* and the generation of the wind noise is suppressed, which enables improvement of the quality of the sound output from the speaker unit 3.

Note that, as in the speaker device 1C illustrated in FIG. 12, the duct 5 may be inclined with respect to the speaker housing 4 so that the orientation of the sound outlet 5*b* does not face the wind W flowing from the front toward the speaker device 1, to make it difficult for the outside air to enter the speaker device 1 from the sound outlet 5*b*, and suppress the generation of the wind noise.

Summary

As described above, the speaker device 1, 1A, 1B, or 1C includes the speaker housing 4 that includes the back wall portion 10*a* covering the speaker unit 3 from the back side, and in which the space between the back surface 3*a* of the speaker unit 3 and the back wall portion 10*a* is formed as the output space 12*a* for the sound output from the back surface 3*a* of the speaker unit 3, and the duct 5 whose internal space 5*a* is communicated with the output space 12*a* and that guides, to the outside of the helmet 100, the sound output to the output space 12*a*.

Since the helmet 100 is used at a construction site, for a disaster prevention purpose, or the like, it is not uncommon to be subjected to a shock. Furthermore, the helmet 100 is also used when a two-wheeled vehicle such as a motorcycle is running, and thus is often subjected to a vibration.

Therefore, in the speaker device 1, 1A, 1B, or 1C, no holes, notches, or the like are formed in the speaker housing 4 and the duct 5 in a path from the back surface 3*a* of the speaker unit 3 to the sound outlet 5*b*, and the high strength of the speaker housing 4 and the duct 5 is ensured. Therefore, even in a case where a shock or vibration is applied to the helmet 100, the speaker device 1, 1A, 1B, or 1C is less likely to be mechanically damaged, and improving the strength makes it possible to ensure good usage conditions of the speaker device 1, 1A, 1B, or 1C.

Furthermore, in the speaker device 1, 1A, 1B, or 1C, the distance A between the back surface 3*a* of the speaker unit 3 and the back wall portion 10*a* is smaller than the distance B of the internal space 5*a* of the duct 5 in the direction of guiding the sound.

Therefore, since the distance A is smaller than the distance B, the speaker housing 4 can be made thinner, which makes it possible to reduce a space for arranging the speaker device 1, 1A, 1B, or 1C inside the helmet 100.

Furthermore, in the speaker device 1, 1A, 1B, or 1C, the sound output from the back surface 3*a* of the speaker unit 3 is emitted from the sound outlet 5*b* to the outside of the helmet 100 through the output space 12*a* and the internal space 5*a*.

Therefore, since the sound output from the speaker unit 3 to the front side and the sound output from the speaker unit 3 to the rear side are not mixed, nor do the sounds output from the speaker unit 3 to the front side and the back side cancel each other out as sounds having opposite phases, it is possible to suppress a decrease in sound pressure sensitivity in a low sound range.

Present Technology

The present technology can be configured as follows.

(1)

A speaker device that is used while being attached to a helmet, the speaker device including:

a speaker unit that outputs a sound, a speaker housing that includes a back wall portion covering the speaker unit from a back side, and in which a space between a back surface of the speaker unit and the back wall portion is formed as an output space for the sound output from the back surface of the speaker unit, and a duct whose internal space is communicated with the output space and that guides, to an outside of the helmet, the sound output to the output space, in which a distance between the back surface of the speaker unit and the back wall portion is smaller than a distance of the internal space of the duct in a direction in which the duct guides the sound.

(2)

The speaker device according to (1), in which at least a part of the speaker housing and at least a part of the duct are integrally formed.

(3)

The speaker device according to (1) or (2), in which an output direction of the sound from the back surface of the speaker unit and the direction in which the duct guides the sound are different directions.

(4)

The speaker device according to (3), in which the output direction of the sound from the back surface of the speaker unit and the direction in which the duct guides the sound are orthogonal directions.

(5)

The speaker device according to any of (1) to (4), in which an opening at a tip of the duct is formed as a sound outlet that emits the sound to the outside of the helmet, and the sound outlet is located below the speaker housing in a state where the speaker device is attached to the helmet.

(6)

The speaker device according to (5), in which the sound outlet is located above a lower opening of the helmet.

(7)

The speaker device according to (5) or (6), in which in the duct, the distance of the internal space in the direction in which the duct guides the sound is smaller toward a rear of the helmet.

(8)

The speaker device according to any of (1) to (4), in which an opening at a tip of the duct is formed as a sound outlet that emits the sound to the outside of the helmet, and the sound outlet is located behind the speaker housing in a state where the speaker device is attached to the helmet.

(9)

The speaker device according to any of (1) to (4), in which a cooling space is formed inside the helmet, an air inflow hole and an air outflow hole communicated with the cooling space are formed in the helmet, and the internal space is communicated with the cooling space.

(10)

The speaker device according to any of (1) to (9), in which a sound emission hole is formed in the helmet, and the internal space is communicated with the sound emission hole.

(11)

The speaker device according to any of (1) to (10), in which the helmet includes a cheek pad provided as an interior part, and the speaker device is attached to the helmet in a state where at least a part of the speaker housing or the duct is held by the cheek pad.

(12)

The speaker device according to (11), in which the speaker device is attached to the helmet in a state where the at least a part of the speaker housing or the duct is sandwiched between the cheek pad and another interior part.

REFERENCE SIGNS LIST

100 Helmet
106 Cheek pad
1 Speaker device
3 Speaker unit
4 Speaker housing
5 Duct
5*a* Internal space
5*b* Sound outlet
10*a* Back wall portion
12*a* Output space
100*a* Sound emission hole
100*b* Cooling space
100*c* Air inflow hole
100*d* Air outflow hole
1A Speaker device
1B Speaker device
1C Speaker device

The invention claimed is:

1. A speaker device attachable to a helmet, the speaker device comprising:

a speaker unit configured to output a sound;

a speaker housing that includes a back wall portion that covers the speaker unit from a back side, wherein the speaker housing includes an annular retaining portion configured to hold a portion of the speaker unit, the speaker housing includes a space between a back surface of the speaker unit and the back wall portion, and the space is an output space for the sound output from the back surface of the speaker unit; and a duct that has internal space communicated with the output space, wherein the duct includes a rectangular flat plate portion integral with the annular retaining portion of the speaker housing, the duct is configured to guide, to an outside of the helmet, the sound output to the output space, and a distance between the back surface of the speaker unit and the back wall portion is smaller than a distance of the internal space of the duct in a direction in which the duct guides the sound.

2. The speaker device according to claim 1, wherein an output direction of the sound from the back surface of the speaker unit is different from the direction in which the duct guides the sound.

3. The speaker device according to claim 2, wherein the output direction of the sound from the back surface of the speaker unit is orthogonal to the direction in which the duct guides the sound.

4. The speaker device according to claim 1, wherein the duct includes an opening at a tip of the duct as a sound outlet, the sound outlet is configured to emit the sound to the outside of the helmet, and the sound outlet is below the speaker housing in a state where the speaker device is attached to the helmet.

5. The speaker device according to claim 4, wherein the sound outlet is above a lower opening of the helmet.

6. The speaker device according to claim 4, wherein a length of the duct, in the direction in which the duct guides the sound, is smaller toward a rear of the helmet than the length of the duct toward a front of the helmet.

7. The speaker device according to claim 1, wherein the duct includes an opening at a tip of the duct as a sound outlet, the sound outlet is configured to emit the sound to the outside of the helmet, and the sound outlet is behind the speaker housing in a state where the speaker device is attached to the helmet.

8. The speaker device according to claim 1, wherein the helmet includes a cooling space, the helmet further includes an air inflow hole and an air outflow hole communicated with the cooling space, and the internal space is communicated with the cooling space.

9. The speaker device according to claim 1, wherein the helmet includes a sound emission hole, and the internal space is communicated with the sound emission hole.

10. The speaker device according to claim 1, wherein the helmet includes a cheek pad as a first interior part, and the speaker device is attached to the helmet in a state where at least a part of one of the speaker housing or the duct is held by the cheek pad.

11. The speaker device according to claim 10, wherein the speaker device is attached to the helmet in a state where the at least the part of one of the speaker housing or the duct is sandwiched between the cheek pad and a second interior part.

12. The speaker device according to claim 1, wherein a width of the speaker housing is substantially equal to a width of the rectangular flat plate portion of the duct in a direction orthogonal to both a thickness direction of the duct and the direction in which the duct guides the sound, and a thickness of the duct is smaller than the width and a length of the duct.

* * * * *